US009085014B2

(12) United States Patent
Ernst

(10) Patent No.: US 9,085,014 B2
(45) Date of Patent: Jul. 21, 2015

(54) VERTICAL DROP PRODUCT CLEANER WITH PERFORATED INTAKE MANIFOLD

(75) Inventor: Matthew J. Ernst, North Oaks, MN (US)

(73) Assignee: Carter Day International, Inc., Minneapolis, MN (US)

( * ) Notice: Subject to any disclaimer, the term of this patent is extended or adjusted under 35 U.S.C. 154(b) by 161 days.

(21) Appl. No.: 13/425,886

(22) Filed: Mar. 21, 2012

(65) Prior Publication Data

US 2013/0068669 A1 Mar. 21, 2013

Related U.S. Application Data

(60) Provisional application No. 61/466,613, filed on Mar. 23, 2011.

(51) Int. Cl.

| | |
|---|---|
| ***B04C 5/02*** | (2006.01) |
| ***B07B 4/00*** | (2006.01) |
| ***B07B 4/02*** | (2006.01) |
| ***B07B 4/04*** | (2006.01) |

(52) U.S. Cl.
CPC ... *B07B 4/00* (2013.01); *B07B 4/02* (2013.01); *B07B 4/04* (2013.01)

(58) Field of Classification Search
USPC ..... 209/135, 136, 138, 210, 642, 643, 717, 209/734; 460/97, 99, 100; 15/301, 353
See application file for complete search history.

(56) References Cited

U.S. PATENT DOCUMENTS

| | | | | |
|---|---|---|---|---|
| 4,568,453 | A * | 2/1986 | Lowe, Jr. | 209/135 |
| 4,865,721 | A | 9/1989 | Smith et al. | |
| 5,685,434 | A * | 11/1997 | Ackerman | 209/135 |
| 6,347,707 | B1 * | 2/2002 | Sussegger et al. | 209/133 |
| 6,405,405 | B1 * | 6/2002 | Hauch | 209/136 |
| 6,845,867 | B2 * | 1/2005 | Sussegger et al. | 209/135 |
| 7,380,671 | B2 * | 6/2008 | Loomans-V. D. Anker et al. | 209/305 |

* cited by examiner

*Primary Examiner* — Gerald McClain
(74) *Attorney, Agent, or Firm* — Fredrikson & Byron, P.A.

(57) ABSTRACT

A vertical grain cleaner having an intake manifold modified to reduce the formation of vortexes and pressure imbalances based on the flow of aspiration air through the cleaner. An intake manifold with a louver defining one or more apertures that allows air to pass through the louver. Methods of operating vertical grain cleaners.

14 Claims, 4 Drawing Sheets

VERTICAL DROP PRODUCT CLEANER WITH PERFORATED INTAKE MANIFOLD

RELATED APPLICATIONS

This application claims the benefit of U.S. Provisional Application Ser. No. 61/466,613, filed Mar. 23, 2011, titled Vertical Drop Product Cleaner with Perforated Intake Manifold, the contents of which are hereby incorporated by reference.

TECHNICAL FIELD

The application relates to vertical drop product cleaners.

BACKGROUND

Vertical drop product cleaners generally rely upon an upward vertical air movement through a granular product falling under gravitational influence and a horizontal or transverse airflow to separate the fines and foreign material from the product and carry it away therefrom. Such cleaners remove fines and foreign material from dry, free flowing particulate matter by using substantially perpendicular air flows through the flowing product.

SUMMARY

According to one aspect of the invention, a vertical grain cleaner is provided having an intake manifold modified to reduce the formation of vortexes and pressure imbalances based on the flow of aspiration air through the cleaner. In some embodiments, an intake manifold of the cleaner includes a louver defining one or more apertures that allow air to pass through the louver. In certain embodiments, the one or more apertures include a plurality of apertures arranged in a series of rows and columns. Such embodiments can be referred to as "perforated" and/or "fenestrated."

Such intake manifolds improve the stability of airflow, and reduce or eliminate vortices. Further, the airflow through the perforated manifold aerates the product and better disperses the product within the boundaries of the cleaner's downward chamber. Such embodiments are useful for increasing the cleaning efficiency of the cleaner, allowing for greater product throughput for a given size of cleaner compared to a cleaner without an intake manifold with apertures.

BRIEF DESCRIPTION OF THE DRAWINGS

The following drawings are illustrative of particular embodiments of the invention and therefore do not limit the scope of the invention. The drawings are not necessarily to scale and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments. Utilizing the teaching provided herein, those skilled in the art will recognize that many of the examples have suitable alternatives that can be utilized.

Figure 1:
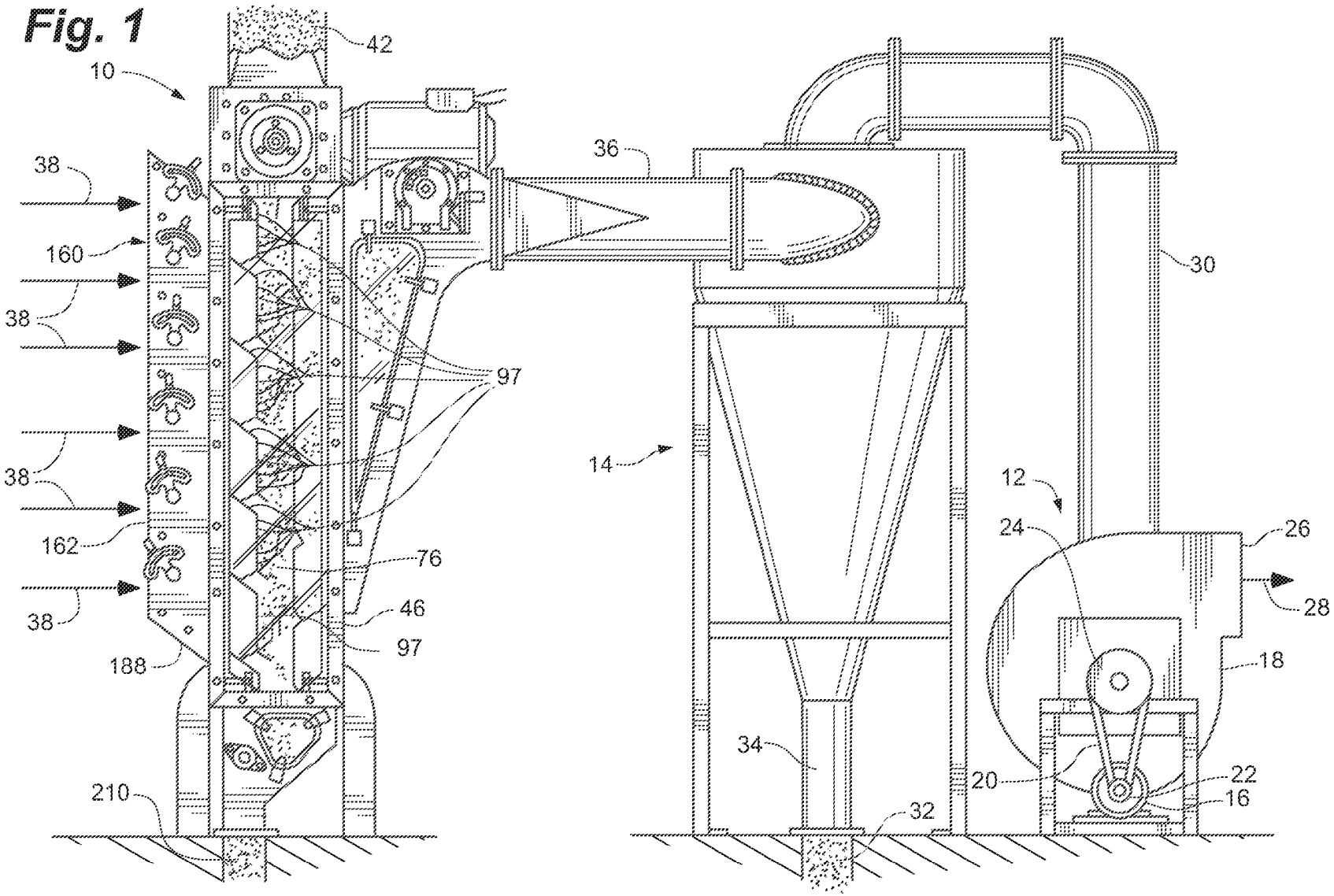
FIG. 1 is a side elevation, partial cross sectional view showing an apparatus in accordance with an embodiment of the invention in an open circuit configuration fluidly connected to a cyclone-type dust collector and blower.

A representative cleaner useful in embodiments of the invention will now be described. However it should be noted that the described cleaner is merely representative, and embodiments of the invention include other cleaners and cleaner configurations. FIG. 1 illustrates a side elevation, partial cross sectional view, of a product cleaner apparatus 10. The cleaner 10 is shown in an open circuit configuration, that is, in a configuration where air from the ambient environment is continuously drawn therein by a negative air pressure created by a fan or blower 12 of known type. The cleaner 10 is shown attached to a cyclone-type dust collector 14 of known type.

Representative blower 12 includes a motor 16 that drives an impeller (not seen) contained within a blower housing 18 that is driven by the motor 16 through a belt 20 extending between a pulley 22 attached to the motor 16 and a pulley 24 attached to the impeller. The blower 12 blows air out through an air outlet 26 as indicated by arrow 28.

Blower 12 is shown fluidly connected to the dust collector 14 by an air outlet 30. Fines and other foreign material 32 settle out of the air flow passing through the collector 14 and drop out of the bottom thereof through an outlet 34 where it can be collected and disposed of. The dust collector 14 in turn can be fluidly connected to the product cleaner 10 by an air outlet 36. Air flows into the cleaner 10 from the ambient environment as indicated by arrow 38 as a result of the negative air pressure created by the blower 12. This air flow 38 into the cleaner 10 can be used to remove fines and other foreign materials from the product to be cleaned.

A representative embodiment of a cleaner 10 will now be described with principal reference to FIGS. 1, 3A and 3B. Cleaner 10 includes a charging inlet 40 into which dirty product 42 to be cleaned can be placed in known manner. In the embodiment shown, the dirty product 42 is held in a charging hopper 44 and metered into housing 46 by a metering reel 48 disposed within the hopper 44. The metering reel 48 acts to deliver product 42 into the housing 46 in a controlled, measured manner, and can be mounted for rotation on a shaft 50 that can be rotated in known manner. In the embodiments shown, dirty product 42 is received between the substantially radially extending vanes 52 of the metering reel 48 along the top thereof and carried by the rotation of the reel 48 to a hopper discharge outlet 54 therebelow such that the dirty product 42 can fall into the housing 46, as best seen in FIG. 1.

Figure 2:
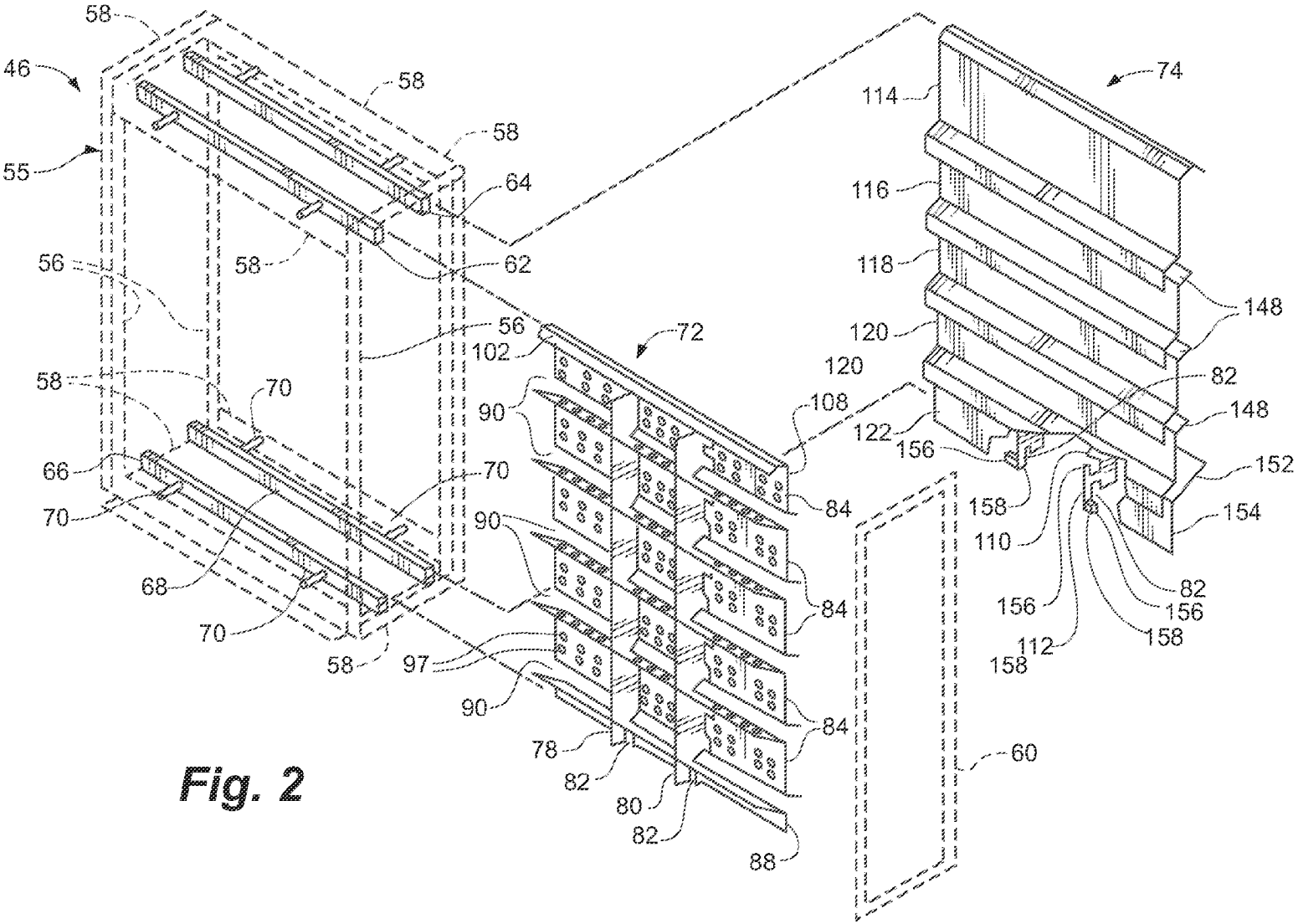
FIG. 2 is an exploded perspective view of an aspirator cleaner in accordance with an embodiment of the invention.

The embodiment of the housing 46 as seen in FIG. 2 comprises an external skeleton 55. As shown, skeleton 55 includes upright corner members 56, illustrated in phantom outline, and transverse members 58 extending between the corner members 56 at opposite ends thereof. As shown, skeleton 55 has a substantially rectangular cross section. Housing 46 further includes a pair of end panels 60 mounted to opposing sides of the housing 46 in any known manner such as nuts and bolts. End panels 60 may include Lexan™ synthetic material. Other materials (e.g., transparent materials) may also be used for the end panels. To facilitate their removal, end panels 60 may be attached by means of hand manipulable fasteners such as wing nuts or the like.

In the embodiment shown, housing 46 also includes a pair of mounting rails 62 and 64 attached at the upper end thereof and a pair of mounting rails 66 and 68 attached at the lower end thereof. Mounting rails 62, 64, 66, and 68 are attached to the skeleton 55 by means of elongate attachment members 70 that are attached to the transverse members 58. As shown, members 70 have a cylindrical configuration and provide a stand-off function of spacing the mounting rails inwardly from the transverse members 58.

As shown, mounting rails 62 and 66 removably mount an inlet manifold 72 and mounting rails 64 and 68 removably mount an outlet manifold 74. Manifolds 72 and 74 are mounted within housing 46 by the rails 62-68 so as to be spaced apart and define therebetween a separation plenum 76. Hopper discharge outlet 54 feeds dirty product 42 into the separation plenum 76 for cleaning of fines and foreign matter from the product.

In some embodiments, inlet manifold 72 comprises a pair of ribs 78 and 80 that extend substantially upright. Ribs 78 and 80 each can include a slot 82 configured to receive and slide upon the lower mounting rail 66 when the inlet manifold 72 is disposed in position in housing 46. Thus, the slots may be configured to have a configuration that matches that of the mounting rail 66, which as shown in the present embodiment is substantially rectangular but could take on other configurations.

Ribs 78 and 80 may be configured to mount thereto a plurality of middle louvers 84, a top louver 84, and a bottom louver 88. As shown, the louvers 84-88 are spaced apart so as to define air inlet channels 90 therebetween.

In the embodiment shown, each middle louver 84 includes upper and lower inlet lips 92 and 94, respectively. Upper inlet lips 92 are shown extending outward in the direction of the inwardly moving airflow 38 while lower inlet lips 94 are shown extending inwardly into the separation plenum 76. The lips 92 and 94 are interconnected by a substantially vertically extending louver member 96.

As shown best in FIG. 2, in accordance with an embodiment of the invention at least one of the louvers further defines at least one aperture 97. Such a louver improves the stability of downward airflow, and reduces or eliminates vortices. Further, the airflow through the apertured louver aerates the product and better disperses the product within the boundaries of the cleaner's separation plenum. Such embodiments are useful for increasing the cleaning efficiency of the cleaner, allowing for greater product throughput for a given size of cleaner compared to a cleaner without an intake manifold with apertures.

The at least one aperture 97 can include any useful shape (e.g., oval, circle, slot) or configuration. In certain embodiments, at least one louver includes a plurality of apertures arranged in a series of rows and columns, and can be said to be perforated or fenestrated. In specific embodiments, the at least one louver includes between about 20 and about 50% (e.g., about 35%) open area defined the by at least one aperture. In some embodiments, the inlet manifold includes a series of louvers that each define a plurality of apertures.

In embodiments where the louver includes an upper inlet lip 92, a lower inlet lip 94, and a vertically extending louver member 96 extending between the upper inlet lip and the lower inlet lip, at least one aperture 97 can be included in the upper inlet lip, the lower inlet lip, or the vertically extending louver member. In other embodiments, the louver includes at least one aperture in the upper inlet lip, the lower inlet lip, and the vertically extending louver member. In yet other embodiments, the louver includes a plurality of apertures in the upper inlet lip, the lower inlet lip, and the vertically extending louver member. In other embodiments, the louver includes a plurality of apertures in the upper inlet lip or the lower inlet lip, and the vertically extending louver member. Apertures included in the vertically extending louver member will reside in a substantially vertical plane.

As shown, some embodiments of the cleaner have a plurality of louvers (e.g., five). In such embodiments, between one and all of the louvers can include any of the aperture configurations described herein, and the remaining louvers can be provided without apertures. For example, the uppermost louver can be provided without apertures, while each louver below the uppermost louver can be provided with apertures. In other embodiments, the uppermost two louvers can be provided without apertures, while each louver below the second uppermost louver can be provided with apertures.

Returning to describing the representative embodiment of a cleaner, top louver 84 can include a lower lip 98 that extends into the space between the manifolds, an upright extending member 96, and a hook element 102. Hook element 102 can be configured to extend over and somewhat around mounting rail 62 and to be slidably received thereby. Thus, when it is desired to clean, maintain or replace the inlet manifold 72, the end panel 60 can be removed and the manifold 72 can be slidably removed from the housing of the product cleaner 10. The cleaning, maintenance or replacement of the manifold can be accomplished and the manifold restored to its operational position within the housing 46. As shown, the hook element 102 can comprise a first, upwardly and outwardly extending member 104 and a second, downwardly and outwardly extending member 106. Members 104 and 106 together create a recess 108 at the members' juncture therebelow. The recess 108 receives the mounting rail 62. Thus, as shown, hook element 102 comprises a pair of angularly disposed members that create a hook by which the inlet manifold 72 can be supported from the mounting rail 62.

The lower louver 88 can include an upper lip 92 similar to the upper lips of the middle louvers 84. As shown, lower louver 88 has no lower lip, though such a lip could be provided if desired.

In some embodiments, outlet manifold 74 can also include a pair of upright extending ribs and a plurality of longitudinally, that is, substantially horizontally extending louvers. In such embodiments, outlet manifold 74 includes ribs 110 and 112, top louver 114, middle louvers 116, 118, 120, and 122, and bottom louver 124. The outlet manifold louvers are spaced vertically apart from each other along the upward extent of the ribs 110 and 112 and extend substantially the entire length of the housing 46. As with the inlet manifold 72, the spacing of the louvers 116-124 creates air outlets 126 for the transverse air flows with five such outlets being shown in FIGS. 3A and 3B. A sixth air outlet 128 can be created between the outlet manifold top louver 114 and a downwardly depending member 130 attached to the charging hopper 44 and extending into the hopper discharge outlet 54.

As shown, outlet manifold top louver 114 comprises a hook element 132, an upright or substantially vertically extending member 134, and a lower lip element 136. In the embodiment shown, lower lip element 136 comprises, as shown, a first inward and downward extending segment 138 and a second inward and downwardly extending segment 140 angularly disposed relative to the first segment 138. The hook element 132 includes first and second hook angularly disposed members 142 and 144, respectively, which can be similar to the first and second hook members 104 and 106 of the top louver 84 of the inlet manifold 72. The juncture of the first and second hook members 142 and 144 forms a recess 146 to slidably receive the mounting rail 64.

The middle louvers 116-120 of the embodiment shown each include an upper lip 148, a lower lip element 136, and an upright or substantially vertically extending member 150 therebetween. The upper lips 148 of one louver and the lower lip element of the next adjacent louver therebelow define the air outlets 126 therebetween. The lower louver 122 includes an extended upper lip 152 and an upright or substantially vertically extending member 154. The ribs 110 and 112 each include slots 82 at their lower ends that are configured to slidably receive the mounting rail 68. In some embodiments, the outlet manifold louver can be substantially free from apertures.

Embodiments of the outlet manifold 74 can thus be slidably removed from the housing 46 as desired for cleaning, maintenance or replacement by the operator of apparatus 10. Where such remedial work is desired, the end panel 60 can be removed, the outlet manifold can be slid outwardly on the mounting rails and the remedial work accomplished. It will be observed with respect to FIG. 2 that the ribs 82 each include at least one flange 156 extending therefrom substantially parallel with the extent of the louvers and including a bolt hole or aperture 158 by which the louvers of manifold 74 can be removably secured to the ribs. The louvers can also be welded to the ribs if desired. Inlet manifold ribs 82 are similarly constructed, though such flanges and are not shown therefore.

Figure 3A:
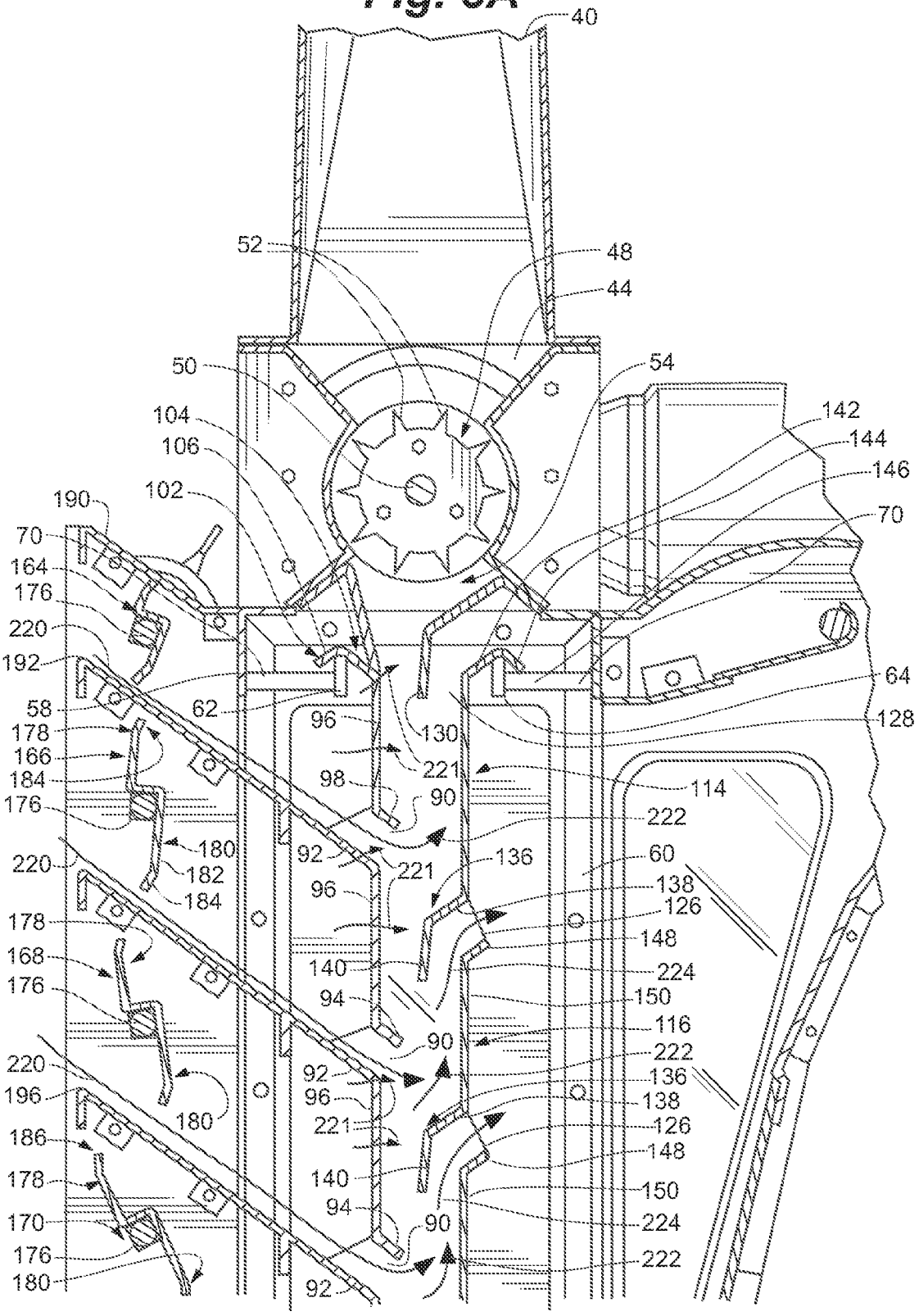
FIGS. 3A and 3B are an end view of the apparatus shown in FIG. 1 in a partial cross sectional view.
Figure 3B:
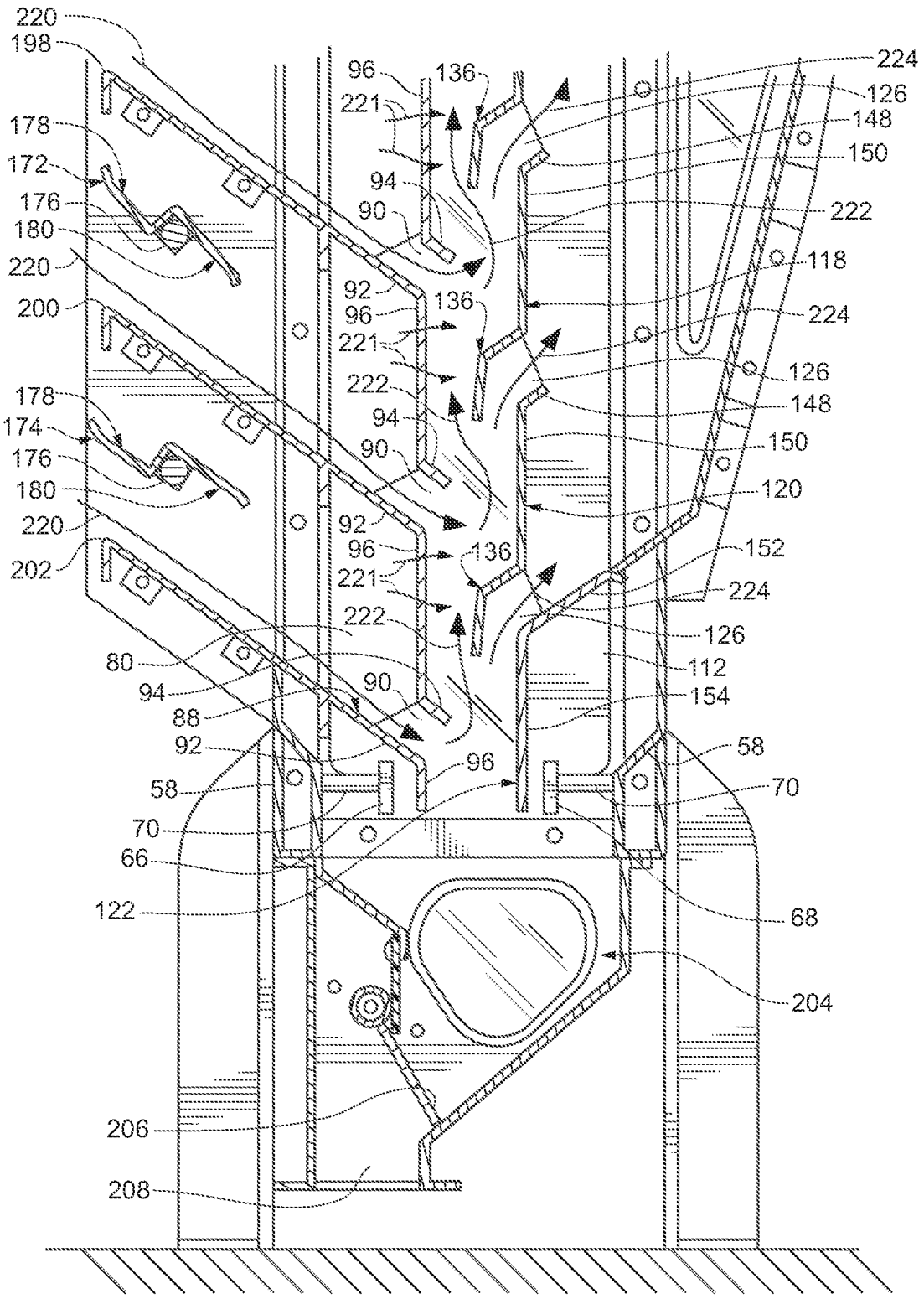

Referring now to FIGS. 1, 3A and 3B, it will be observed that the present invention 10 may be equipped with a velocity control module 160. Module 160 can be attached to the air inlet side of the housing 46 and include a plurality of dampers that can be selectively adjusted to control the airflow passing through each of the air inlets 90. The adjustment for the individual air inlets can be made manually or automatically based upon sensed readings of the air flow through the individual air inlets.

In the embodiment shown, module 160 includes a module housing 162. Mounted therein are a plurality of dampers 164, 166, 168, 170, 172, and 174 that extend substantially the length of the housing 46. Each damper 164-172 can be mounted for synchronous rotation with and on a damper shaft 176. Each damper 164-172 includes a pair of damper vanes 178-180 that extend outwardly from the shaft 174. The vanes 178 and 180 can each include a radially inward first portion 182 and a radially outward second portion 184 angularly disposed relative thereto. Each damper 164-174 can be contained within its own damper unit or air passage comprising end walls 186 and 188 of the module 160 ceiling and floor elements. In the embodiment shown, damper 164 has a ceiling element 190 and a floor element 192 while damper 166 immediately therebelow has a ceiling element formed by floor element 192 of damper 164 and a floor element 194. The module 160 can include a plurality of inwardly and downwardly extending dividers 190, 192, 194, 196, 198, 200, and 202 that engage the upper lips 92 of the inlet manifold louvers so as to cooperate in defining a flow path or air passage for ambient air entering the velocity control module and the product cleaner 10. Each air passage can communicate with one of said air inlets 92. Rotation of the shafts 176 can cause the vanes to rotate therewith and to open or close the air passage accordingly. That is, rotation of the shafts 176 and thus the vanes can change the size of the corresponding air passage and enable the operator to control the air flow through the passage into its respective air inlet 92. With the use of the velocity control module 160 the volume and velocity of ambient air entering the cleaner 10 can be controlled such that the cleaning operation can more efficiently take place.

The operation of a representative cleaner will now be described. Referring to FIG. 1, it will be observed that product enters the cleaner 10 and can be metered into the separation plenum 76. As the product falls under gravitational influence it cascades alternately back and forth across the plenum 76 due to the action of engaging the upper and lower lips of the louvers forming the inlet and outlet manifolds. Thus, as a representative example of such falling action, falling product will engage the lower lip element 136 of an air outlet manifold louver and be directed thereby, that is, given a velocity component substantially transverse to the gravitational velocity, in the direction of the opposing air inlet manifold louver on the opposing side of the separation plenum 76. The product will "bounce" to the other side of the separation plenum where it will engage the upright portion 96 and lower lip 94 of an inlet manifold louver, the lower lip 94 redirecting the falling product back across again. It this way the falling product can be tumbled by the inwardly extending lower lips of the manifold louvers to expose the surface of the granular product to the upward and transverse air flow through the apparatus for removal of fines and other materials and to expose the fines and foreign materials to the air flow to allow and facilitate its removal from the falling product, thus cleaning it.

Referring now to FIGS. 1 and 3B, as the falling product encounters the lower lip 94 of the lower louver 88 it falls into a discharge hopper 204. Hopper 204 may include a spring loaded or biased discharge gate 206 as shown. The cleaned product 210 will fall out of the hopper 204 through a discharge chute 208 and into the appropriate product conveyor (not shown) to be conveyed away for use or transport as desired.

Air can be moved (e.g., forced or drawn) through the separation plenum via a blower 12. Blower 12 can create a negative air pressure within the apparatus 10, causing ambient air to enter the velocity control module 160 as indicated by arrow 38 and pass through the apparatus shown in FIG. 1 to exit therefrom as indicated by arrow 28. More specifically, ambient air can enter the velocity control module 160 and pass through the air inlets 90 and apertures 97 into the separation plenum 76 as indicated by arrows 220 and 221, respectively, shown in FIGS. 3A and 3B.

As the air flow 220 enters the separation plenum it will split into an upwardly directed air flow through the falling product 42, as indicated by arrow 222, and a transverse air flow exiting the through the air outlets 126 as indicated by arrow 224. The upward air flow 222 "fluffs" the falling product and separates the fines and foreign materials contained therein therefrom, allowing the transverse air flow 226 to carry the fines and foreign materials away through the air outlets 126 and into the air outlet 36 to the collector 14 where it settles out as previously described. In this manner, then, the dirty product 42 can be cleaned to yield clean product 210 and fines and foreign materials 32.

Because of the presence of the apertures 97, air flow will be improved. More specifically, such apertures will improve the stability of airflow and reduce or eliminate vortices. Further, the airflow through the aperture aerates the product and better disperses the product within the boundaries of the cleaner's separation plenum. Such embodiments are useful for increasing the cleaning efficiency of the cleaner, allowing for greater product throughput.

In the foregoing detailed description, the invention has been described with reference to specific embodiments. However, it may be appreciated that various modifications and changes can be made without departing from the scope of the invention.

What is claimed is:

1. A vertical drop product cleaner for separating fines and/or foreign matter from dry, free-flowing, granular product, the cleaner comprising:

a housing;

a separation plenum formed by spaced inlet and outlet manifolds within the housing;

the inlet manifold including at least two louvers defining an air inlet channel therebetween to provide a flow path for air into the separation plenum, at least one of the louvers including an upper inlet lip, a lower inlet lip, and a vertical louver member, the upper inlet lip and lower inlet lip each extending at an angle off of the vertical louver member, and the at least one louver further defining a plurality of apertures configured to allow airflow therethrough, the plurality of apertures being included in the vertical louver member; and the outlet manifold defining at least one air outlet providing a flow path for air out of said separation plenum.

2. The cleaner of claim 1, wherein the inlet manifold includes a series of louvers each defining a plurality of apertures.

3. The cleaner of claim 1, wherein the plurality of apertures are arranged in a series of rows and columns.

4. The cleaner of claim 1, wherein the plurality of apertures comprise perforations.

5. The cleaner of claim 1, wherein the plurality of apertures comprise fenstration.

6. The cleaner of claim 1, wherein the at least one louver includes between 20% and 50% open area defined the by the plurality of apertures.

7. The cleaner of claim 1, wherein at least one of the upper inlet lip and the lower inlet lip further include the plurality of apertures.

8. The cleaner of claim 1, wherein the upper inlet lip, the lower inlet lip, and the vertical louver member each include the plurality of apertures.

9. The cleaner of claim 1, wherein the outlet manifold includes at least one outlet louver, the outlet louver being substantially free from apertures.

10. A method of operating a vertical drop product cleaner comprising the steps of:

providing a vertical drop product cleaner having a separation plenum formed by spaced inlet and outlet manifolds, the inlet manifold including at least two louvers defining an air inlet channel therebetween, at least one of the louvers including an upper inlet lip, a lower inlet lip, and a vertical louver member, the upper inlet lip and lower inlet lip each extending at an angle off of the vertical louver member, and the at least one louver further defining a plurality of apertures in the vertical louver member; and moving air through the air inlet channel and the plurality of apertures.

11. The method of claim 10, wherein the outlet manifold includes at least two outlet louvers defining an air outflow channel therebetween, the at least two outlet louvers being substantially free from apertures, further comprising the step of moving air through the air outflow channel.

12. The method of claim 10, wherein the plurality of apertures are arranged in a series of rows and columns.

13. The method of claim 10, wherein the at least one louver includes between 20% and 50% open area defined the by the plurality of apertures.

14. The method of claim 10, wherein the upper inlet lip, the lower inlet lip, and the vertical louver member each include the plurality of apertures, and moving air through the plurality of apertures comprises moving air through the plurality of apertures in each of the upper inlet lip, the lower inlet lip, and the vertical louver member.

* * * * *